US007163742B2

(12) United States Patent
Koyanagi et al.

(10) Patent No.: US 7,163,742 B2
(45) Date of Patent: Jan. 16, 2007

(54) PRE-ORIENTED YARN PACKAGE

(75) Inventors: Tadashi Koyanagi, Nobeoka (JP); Akira Yamashita, Nobeoka (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 228 days.

(21) Appl. No.: 10/275,705

(22) PCT Filed: May 11, 2001

(86) PCT No.: PCT/JP01/03964

§ 371 (c)(1),
(2), (4) Date: Nov. 8, 2002

(87) PCT Pub. No.: WO01/85590

PCT Pub. Date: Nov. 15, 2001

(65) Prior Publication Data

US 2003/0180533 A1 Sep. 25, 2003

(30) Foreign Application Priority Data

May 12, 2000 (JP) ..... 2000-139456
May 29, 2000 (JP) ..... 2000-158236

(51) Int. Cl.
*D02G 3/04* (2006.01)

(52) U.S. Cl. ..... 428/364

(58) Field of Classification Search ..... 242/159; 428/364; 264/210.2, 210.8, 211.2
See application file for complete search history.

(56) References Cited

U.S. PATENT DOCUMENTS 4,475,330 A 10/1984 Kimura et al.
5,645,782 A 7/1997 Howell et al.
6,284,370 B1 * 9/2001 Fujimoto et al. ..... 428/364
6,423,407 B1 * 7/2002 Abe et al. ..... 428/364
6,440,555 B1 * 8/2002 Yuuki et al. ..... 428/364
6,495,254 B1 * 12/2002 Abe et al. ..... 428/364
6,620,502 B1 * 9/2003 Fujimoto et al. ..... 428/357
6,682,815 B1 * 1/2004 Koyanagi et al. ..... 428/364

FOREIGN PATENT DOCUMENTS

JP 11100721 4/1999
JP 2000-73230 3/2000

* cited by examiner

*Primary Examiner*—Kathy Matecki
*Assistant Examiner*—Scott Haugland
(74) *Attorney, Agent, or Firm*—Finnegan, Henderson, Farabow, Garrett & Dunner, L.L.P.

(57) ABSTRACT

A polytrimethylene terephthalate preoriented package, formed of wound layers and weighing 2 kilograms or more, of a poly (trimethylene terephthalate), in which the yarn package satisfies the following conditions (1), (2) and (3):

(1) a difference in diameters between the edge portions and middle portion of the package is in a range from 0 to 5 mm;

(2) a difference in dry thermal shrinking stress values between the yarn laid at the end portions and the yarn at the middle portion of the package is 0.01 cN/dtex or less; and (3) a yarn size evenness variation value U % is 1.5% or less, and a coefficient of variance of periodicity of yarn size variation is 0.4 or less, both as measured when the wound preoriented yarn is being unwound from the package.

The preoriented yarn package according to the invention is formed of a wound preoriented yarn which has substantially no differential thermal shrinking stress values between the yarn wound (accumulated) at the edge portions in the package and the yarn wound at the middle portion in the package. The present yarn package enables production of a dyed woven or knitted fabric with soft hand, which is substantially free from the occurrence of periodical uneven dyeing.

2 Claims, 6 Drawing Sheets

PRE-ORIENTED YARN PACKAGE

TECHNICAL FIELD OF THE INVENTION

This invention relates to a package of pre-oriented poly (trimethylene terephthalate) yarn produced by melt spinning, a process for producing the package and a method for false-twist texturing the preoriented poly (trimethylene terephthalate) yarn. More precisely, this invention relates to a package in which the preoriented yarn is wound; the preoriented poly (trimethylene terephthalate) yarn as unreeled from the package can be converted to either a woven fabric or a knitted fabric without drawing, and also can be processed by draw false-twist texturing to produce a textured yarn material for providing either a woven or a knitted fabric with a soft hand with a quality free from the occurrence of a periodical irregularity of dyeing. The invention also relates to a method for the preparation of a package of the reoriented poly (trimethylene terephthalate) yarn as well as a method for false-twist texturing a preoriented yarn using a package on which such preoriented yarn is wound.

BACKGROUND ART

Poly (ethylene terephthalate) fiber (hereinafter referred to as "PET fiber") is recognized as a most suitable synthetic fiber for use in clothing, and is manufactured world wide in vast amounts by in the fiber industry.

Poly (trimethylene terephthalate) fiber (hereinafter referred to as "PTT fiber") is known in the prior art literatures such as (A) J. Polymer Science; Polymer Physics Edition Vol. 14 P263–274 (1976), (B) Chemical Fibers International Vol. 45, April (1995) 110–111, (C) Japanese Unexamined Patent Publication (Kokai) No. 52-5320, (D) Japanese Unexamined Patent Publication (Kokai) No. 52-8123, (E) Japanese Unexamined Patent Publication (Kokai) No. 52-8124, (F) WO99/27168 and so on.

The prior art documents (A) and (B) describe some basic properties of PTT fiber such as stress-elongation characteristic and the like, and suggest that the fiber material is suitable for use in clothing in which a low initial modulus property and excellent stretch recovery are required, and in carpets and the like articles.

In Documents (C), (D), (E) and (F), several methods of improving the fiber in thermal dimensional stability and stretch recovery have been proposed for promotion of the best use of the afore-mentioned inherent characteristics of PTT fiber.

As a PTT fiber obtained by high speed spinning, a pre-oriented yarn for drawing is described in Document (G) Japanese Unexamined Patent Publication (Tokuhyo) No. 9-509225 and (H) Japanese Unexamined Patent Publication (Kokai) No. 58-104216, and a partially oriented yarn for use in draw false-twist texturing is disclosed in (I) Chemical Fibers International Vol. 47, February, 1997, pages 72 to 74 and (J) Japanese Unexamined Patent Publication (Kokai) No. 2001-20136. Meanwhile, a preoriented yarn of PTT fiber provided for producing a knitted or woven fabric without drawing (with the elimination of drawing) is proposed in (K) Japanese Examined Patent Publication (Kokoku) No. 63-42007.

A yarn wound at a spinning speed of 2000 to 5000 m/min is described in Document (G), and a preoriented yarn having a birefringence of 0.035 or greater obtained by spinning at a spinning speed of 2000 m/min or more, which is provided for drawing, is described in Document (H). In document (I), a partially oriented yarn for false-twist texturing is described; the partially oriented yarn is a PTT yarn obtained by a spinning process in which the spun yarn is wound at a speed of from 3,000 to 6,000 m/min either not through a godet roll or through a heated godet roll.

According to a study by the inventors, the pre-oriented yarns prepared by the methods described in Documents (G) to (I) are highly oriented, but are scarcely crystallized to have a glass transition temperature ranging from 35 to 45° C. A less or non-crystallized pre-oriented yarn is much move sensitive to a variation in the ambient temperature and moisture. For example, the temperature of a package of a pre-oriented yarn rises during take-up winding step by the transfer of heat generated in the motor on a take-up winder and the heat generated by friction between the package and the pressing roll. When the temperature of the package rises due to such a cause, the preoriented yarn is shrunk on the package during winding.

The shrinkage of a preoriented yarn during winding scarcely occurs at the traverse stroke end portions of the package where the yarn is accumulated to form a hard layer of yarn, and rather occurs mainly around the middle portion of the accumulated layer of the wound yarn. As a result, the package comes to form protruded end portions at its end face corners during take-up winding. Once the protruded high portions are formed, with the increase of amount of wound layer, the generation of frictional heat is concentrated on the protruded high portions of the wound package. As a result, a package wound-up in a prescribed diameter of take-up winding forms a package with two protruding end corners at which the diameter is greater than the diameter of the middle potion of the package; the formation of a package with protruding high end portions. FIG. 1 is a drawing that illustrates schematically the shape of a package with no protruded end portions. FIG. 2 shows schematically another form of package with protruded end portions.

In a package with protruding end portions, the yarn accumulated at the traverse stroke end portions and accumulated at the middle portions differ in thermal characteristic and yarn size.

The preoriented yarn wound at stroke end portions and that wound at the middle portion have different thermal shrinkage stress values (dry thermal shrinking stress), which is measured using a device herein after described. Generally, a thermal shrinking stress value at the stroke end portions of package is greater than that of the preoriented yarn wound at the middle portion of package. When a fabric is formed of the yarn, the difference in thermal shrinkage characteristic contained in the yarn comes to be seen as a difference in shrinking ratio.

Variation of yarn size shows a periodic change corresponding to the length (one traverse stroke) of yarn or two strokes corresponding to the length (one traverse stroke) of yarn from one end of the package to the other end of the package or 2 strokes formed by traversing strokes of the winding machine on which the preoriented yarn is taken up. In FIGS. 3 and 4, examples of yarn size variation charts measured by an evenness tester while a preoriented yarn is being unreeled from the package on which the yarn is wound. FIG. 3 is a chart corresponding to the package shown in FIG. 1, and FIG. 4 is a chart corresponding to the package shown in FIG. 2. In the measurement charts, the periodic variation is observed as hair-like signals equidistantly extending downward towards the smaller yarn size side. The existence of downward signals suggests that the yarn size (=thickness of yarn) at the point in the lengthwise direction of yarn changes towards smaller yarn size.

When a preoriented yarn package in which the defects mentioned above dwell is used either for making fabric, or for draw-false-twist texturing, the resultant products are liable to produce periodical unevenness of dyeing and/or luster, because the package generally is poor in even dyeability. It has been estimated that quality of final fabric goods made from the preoriented yarn package is exceedingly lowered.

In the meantime, Document (K) discloses a process comprising spinning a PET compounded with PTT and/or poly (butylene terephthalate), solidifying the extruded yarn by cooling, heat-treating the solidified yarn by means of a heated roll and subsequently winding at a rate of 3,500 m/min or more. In a comparative example disclosed in the prior art document, a PET homopolymer and a copolymer of PTT composed of PTT homopolymer blended with a PET at 10% by weight is spun at a spinning speed of 4,000 m/min. With the heated-roll at a temperature of 180° C. in the same manner as mentioned above, and the resultant yarn is used without being drawn for making a knitted or a woven fabric.

A study made by the inventors has revealed that a package having a diameter of winding of about 20 to 40 cm, that is economically required, cannot be obtained because the package tends to collapse with an increase in its diameter in a condition where the heat treatment is applied to the yarn during winding at an elevated temperature exceeding 180° C.

The undrawn yarn is frequently broken or fluffed during the heat-treatment at such an elevated temperature because the melting point of PTT is 230° C. Accordingly, the technique of the prior art cannot satisfy commercial-scale production.

The prior art Document (J) discloses a preoriented yarn in which the yarn is heat-treated by means of a godet roll heated at a temperature of from 70 to 170° C. before the yarn is taken up by winding. The method disclosed in the prior art provides a package by which a stabilized draw false-twist texturing of preoriented yarn can be performed for a prolonged period of time. However, it has been found that the method of the prior document does not provide effective means for removing the problems of the protruded edge formation due to the build-up of heat on the package during winding and the periodic occurrences of uneven dyeing caused therefor.

As can be understood from the discussion set forth above, no package enabling production of a fabric, either woven or knitted fabric, in good quality, is known in the prior art relating to a PTT preoriented yarn.

The object of the invention is to provide an improved PTT preoriented yarn package suitable for producing clothing and a process for producing such a package in a stable industrial operation; a preoriented yarn wound on the package is used without drawing, or after being processed into a draw false-twist textured yarn, for either weaving or knitting to produce a fabric having a good quality free from dyeing defects such as a periodically occurring unevenness of dyeing and having softness.

A further specific object of the invention is to provide a PTT preoriented yarn package which is obtained by winding the PTT preoriented yarn and in which the thermal shrinkage variation and yarn size variation of the preoriented yarn, which characteristics are attributable to the edge portion of the package, are removed.

BRIEF DESCRIPTION OF THE DRAWINGS

1, polymer tip drying apparatus; 2, extruder; 3, vent; 4, spin-head; 5, spin-pack; 6, spinning nozzle; 7, multifilamentary yarn; 8, cooling air flow; 9, spin oil applicator; 10, heated godet roll; 11, godet roll and 12, preoriented yarn package

DISCLOSURE OF THE INVENTION

Figure 1:
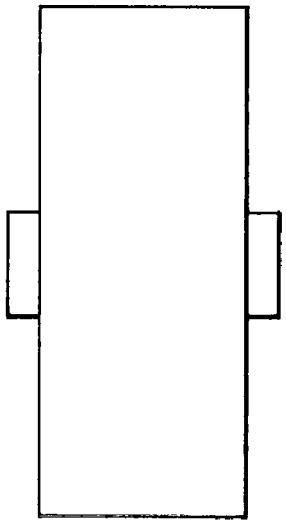
FIG. 1 is a schematic illustration showing a good shaped package free from formation of protruded edge portions.

In a production of a PTT preoriented yarn, formation of a preoriented yarn package with protruded end edge portions is prevented by forming a preoriented yarn package by winding a PTT preoriented yarn under a specific temperature at a specific winding speed, and consequently the hand feel and the quality of an article produced therefrom, such as a woven fabric and a knitted fabric, are enhanced. The present invention is based on this finding.

The object of the invention can be achieved by a PTT preoriented yarn package formed of a PTT preoriented yarn, having a specific crystalline structure, in which the thermal shrinkage characteristic and the yarn size of the yarn accumulated at the edge portions and those of the yarn accumulated at the middle portion of the package are controlled in a specific range, respectively.

The first aspect of the present invention is a polytrimethylene terephthalate preoriented yarn package in which the PTT yarn is formed of a poly (trimethylene terephthalate) having an intrinsic viscosity of from 0.7 to 1.3 dl/g, comprising at least 95 mole % of trimethylene terephthalate repeating unit and 5 mole % or less of another ester-repeating unit, and is accumulated forming a layer of wound yarn weighing 2 kg or more satisfying the following conditions (1) to (3):

(1) a difference in diameter between the edge portion of the package and the middle portion being in a range from 0 to 5 mm;

(2) a difference in thermal shrinkage of the yarn accumulated at the edge portions and that of the yarn accumulated at the middle portion of the package is 0.01 cN/dtex or less; and (3) a U % value, a variation in yarn size measured while the preoriented yarn is unreeled from the package, is 1.5% or less, and a variation coefficient of period of yarn size variation is 0.4% or less.

The second aspect of the present invention is a process for producing a poly (trimethylene terephthalate) preoriented yarn package, in which a poly (trimethylene terephthalate) having an intrinsic viscosity of from 0.7 to 1.3 dl/g, comprising at least 95 mole % of trimethylene terephthalate repeating unit and 5 mole % or less of another ester-repeating unit, is melt-spun, and the spun yarn is taken up by take-up winding as a preoriented yarn after being cooled, by means of cooling air flow, to a solid, characterized in that the yarn is taken up by winding at a winding speed of 1,900 to 3,500 m/min while the tension in the yarn under winding is kept at 0.20 cN/dtex and temperature of the package is kept cooled to 30° C. or less during take-up winding.

The third aspect of the invention is a process for producing a poly (trimethylene terephthalate) preoriented yarn package, in which a poly (trimethylene terephthalate) having an intrinsic viscosity of from 0.7 to 1.3 dl/g, comprising at least 95 mole % of trimethylene terephthalate repeating unit and 5 mole % or less of another ester-repeating unit, is melt-spun, the melt spun yarn is taken up by take-up winding as a preoriented yarn after the spun yarn being cooled by means of cooling air flow to solidify, characterized in the taking-up winding is performed while satisfying the following conditions:

(a) the spinning tension in the yarn is kept at 0.20 cN/dtex or less;

(b) the temperature of the heat treatment is kept in a range from 70 to 120° C. and the tension in the yarn is kept in a range from 0.02 to 0.10 cN/dtex during the heat treatment;

(c) the temperature of the package is held at 30° C. or less while yarn is taken up; and (d) the take-up speed is in a range from 1,900 to 3,500 m/mm when the yarn is taken-up winding on a package.

The fourth aspect of the present invention is a process, for false twist or draw false twist texturing a poly (trimethylene terephthalate preoriented yarn, in which a poly (trimethylene terephthalate) having an intrinsic viscosity of from 0.7 to 1.3 dl/g, comprising at least 95 mole % of trimethylene terephthalate repeating unit and 5 mole % or less of another ester-repeating unit, is melt-spun, and the melt spun yarn is taken up by take-up winding as a preoriented yarn after the spun yarn is cooled by means of a cooling air flow, and subsequently the preoriented yarn is subjected to a false twist texturing process, characterized in that the take-up winding speed of the preoriented yarn is in a range from 1900 to 3500 m/min, and the temperature of the preoriented yarn package is held at 30° C. or less in the whole course of all the steps from the take-up winding storing and to the false twisting texturing process.

In the following, the inventions will be explained in more detail.

The first invention according to the present invention is PTT preoriented yarn package. In the present invention, the PTT polymer composing the PTT preoriented yarn comprises 95 mole % or more of trimethylene terephthalate repeating unit and the remaining 5 mole % or less of other ester repeating unit. A PTT preoriented yarn is composed of a PTT homopolymer or a PTT copolymer containing an ester-repeating unit other than trimethylene terephthalate. The following are included as representative examples of a copolymerized component.

As acid component, an aromatic dicarboxylic acid such as isophthalic acid, 5-sodium sulfo iso-phthalic acid and the like, an aliphatic dicarboxylic acid such as adipic acid, itaconic acid and the like, a hydroxycarboxylic acid such as hydroxybenzoic acid and the like are enumerated by way of example. As glycol component, ethylene glycol, butylene glycol, polyethylene glycol and the like are enumerated. More than two kinds of the acid and/or glycol components may be copolymerized.

A PTT preoriented yarn according to the present invention may contain delustering agent such as titanium oxide and the like, a heat resistance agent, an antioxidant, an anti-static agent, an ultra-violet ray absorber, a mildew proofing agent and various pigments and the like, as an additive or a copolymerizing component.

The PTT preoriented yarn in the present invention must have an intrinsic viscosity ranging from 0.7 to 1.3 dl/g. With an intrinsic viscosity of 0.7 dl/g or less, a false-twist textured yarn obtained has a low tenacity, and a resultant fabric thereof has low mechanical strength. Accordingly, use of the fabric, for example, for sport wear is restricted. With an intrinsic viscosity exceeding 1.3 dl/g, preoriented yarn is liable to break during a production stage and stable production of the preoriented yarn becomes difficult to carry out. A preferred range of intrinsic viscosity is from 0.8 to 1.1 dl/g.

PTT polymer in the present invention can be prepared by using a known process. A representative example is a two stage process in which a polymerization is first carried out by means of melt-polymerization until the intrinsic viscosity of a polymer reaches a certain level, and subsequently the degree of polymerization of the resultant polymer is increased up to the prescribed level of polymerization by solid phase polymerization.

In the following, the structural condition of the PTT preoriented yarn package of the present invention will be explained in detail.

1) Difference in Diameters Within a Package

In the present invention, a difference in diameters within a package between the edge portions and the middle portion must be in a range from zero to 5 mm. With a diameter exceeding 5 mm, the periodicity of yarn size variation become remarkable in a yarn size variation measurement. When a periodicity of yarn size variation becomes remarkable, periodical dyeing variations become noticeable in a false twist textured yarn. For nonoccurrence of periodical variation in a false-twist yarn, the difference in diameters in the package is preferably 4 mm or less, more preferably 2 mm or less. The difference in the diameters of a package between the edge portions and the middle portion of the package is an indication (index) representing the degree of "protrusion height of the edges of a package." In case where a diameter of winding of a package is 10 cm or less, the difference is insignificant. On the other hand, in case where a diameter of winding of a package exceeds 20 cm, the increase in diameter difference between the diameters become significant, whereby edge protrusion becomes remarkable.

In the present invention, a preoriented yarn package has preferably a diameter of winding of 20 cm or greater. The diameter of a preoriented yarn package is generally in a range of about 20 to about 40 cm in the trade. With a package having a diameter of winding of 20 cm or less, the winding amount on a package is too small to be industrially used; the expense for the paper tube or bobbin on which yarn is taken up by winding, and expense for wrapping of package, wrapping materials and transportation of the package all in all become costly in comparison of the price of the preoriented yarn taken up in a package.

A preferred winding width of the preoriented yarn package of the present invention is in a range from 8 to 25 cm. When a winding diameter of package is identical, the greater the winding width of a package, the greater the amount of winding becomes and, accordingly, the package becomes industrially advantageous. When a winding width of a package is small, protrusion edge portions are liable to form because the ratio of winding width to edge portions in a package increases. A preferred winding width of a package ranges from 10 to 25 cm, more preferably from 15 to 25 cm.

2) Dry Shrinking Stress of Preoriented Yarn

The dry heat shrinking stress indicates the shrinking force exhibited by a preoriented yarn under the influence of heat. A PTT preoriented yarn generally produces a shrinking force at temperature of about 50° C. and exhibits a peak value of shrinking stress at about 60 to 80° C. This peak value is read as the dry heat shrinking stress. The preoriented yarn accumulated at the edge portion of a package tends to have a greater dry heat shrinking stress than the preoriented yarn accumulated at the middle portion of the package. In the present invention, the difference in the dry heat shrinking stress values must be 0.01 cN/dtex or less between the yarn accumulated at the edge portions of a package and the yarn accumulated at the middle portion of the package. When a difference in the dry heat shrinking stress values exceeds 0.01 cN/dtex, the yarn accumulated at the edge portion of package produces hike or barré and/or dyeing defects in the ultimate fabric obtained from the package, and the quality of the fabric deteriorates in quality. The difference in dry heat shrinking stress values is preferred to be smaller and preferably 0.005 cN/dtex or less.

3) Variation in Yarn Size

In the present invention, a value of yarn size variation and the periodicity of yarn size variation, which are measured while the preoriented yarn is unwound or unreeled from package must be 1.5% or less and 0.4% or less, respectively. The yarn size variation is a value measured by a known yarn variation measurement. In the present invention, the value, U % of yarn size variation must be 1.5% or less. With a value exceeding 1.5%, quality of dyeing of a fabric either knitted or woven deteriorates. When a yarn has a value of 1.5% or less, the yarn exhibits a quality good enough to be usable in the industry for the manufacture of woven and knitted fabrics. With the value exceeding 1.5%, yarn does not produce qualified goods, and use of the yarn in this field becomes impossible. The smaller the value, U % of yarn size variation, the better the quality of fabric obtainable. A preferred U % value of yarn size variation is 1.2% or less, more preferred is 1.0% or less. In the present invention, it is necessary that not only yarn size variation U% is 1.5% or less, but also variation coefficient of yarn size variation according to periodicity analysis of yarn size variation is 0.4% or less. Even if a U % value of the yarn size variation is 1.5 or less is satisfied, knitted or woven fabric of good quality cannot be obtained when a variation coefficient of periodicity of yarn size variation exceeds 0.4% because abnormality of dyeing attributable to the edge portions of preoriented yarn package is produced in the fabric. The problem comes into existence specifically when the yarn is woven in a high weave density as the warp and weft yarns into a weave texture, especially in case where the preoriented yarn is fabricated without being texturinzed by draw false-twisting processing.

Figure 3:
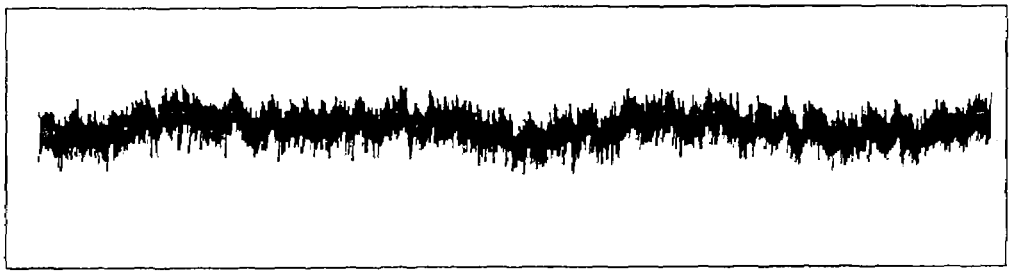
FIG. 3 is an example of diagram showing a measurement chart of U %, a yarn size variation value.
Figure 4:
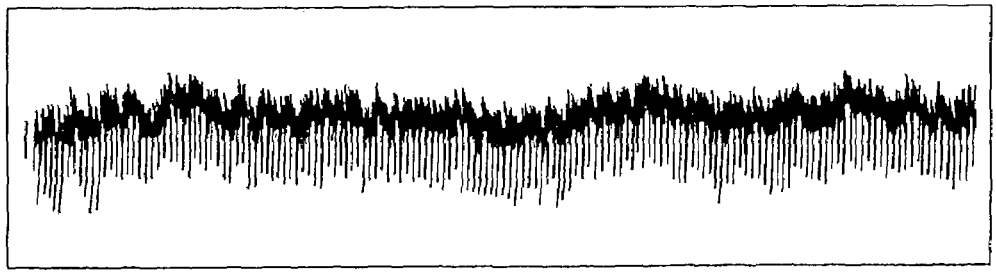
FIG. 4 is another example of diagram showing a measurement chart of U %, a yarn size variation value.
Figure 5:
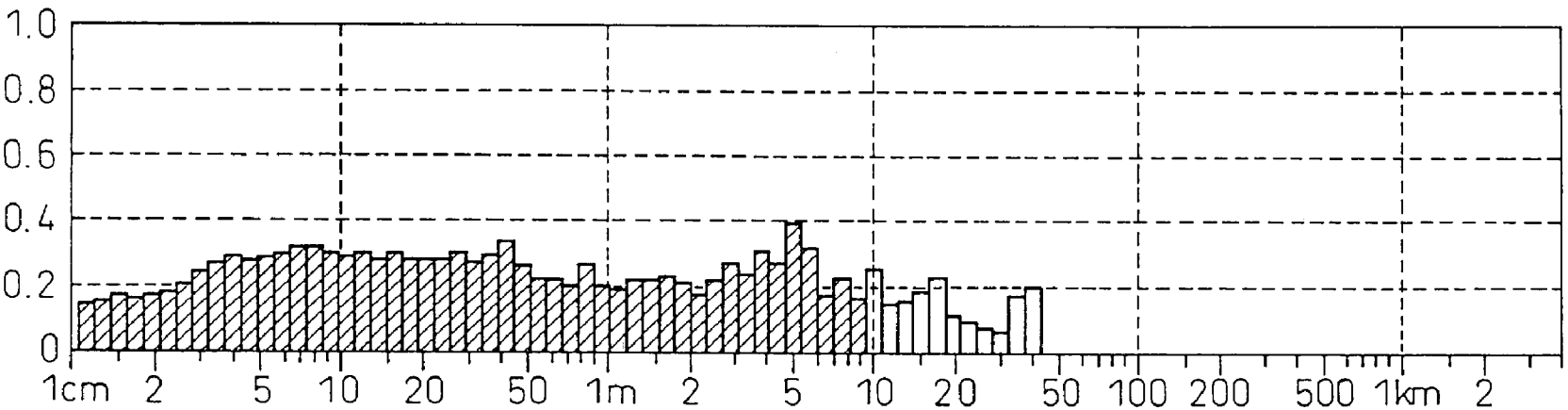
FIG. 5 shows is still another example of diagram showing a periodical variation of yarn size.
Figure 6:
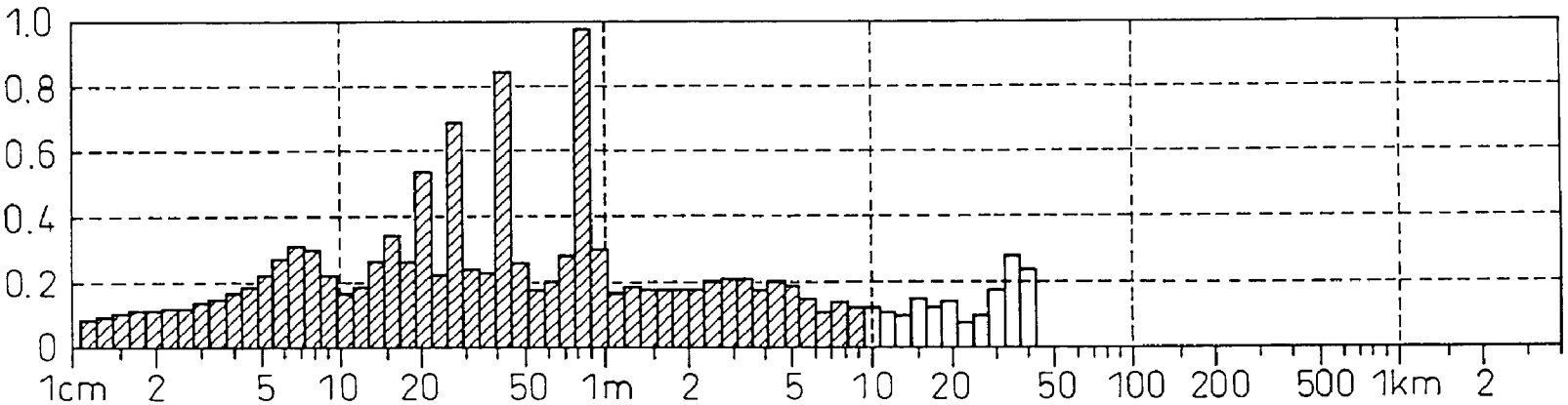
FIG. 6 shows is still further example of diagram showing a periodical variation of yarn size.

The variation coefficient can be found by means of periodicity analysis of yarn size variation dependent on the yarn size variation measurement as explained hereinafter. In FIG. 5, an example of a chart for periodicity analysis of yarn size variation corresponding to FIG. 3 is shown, and in FIG. 6, another example of chart for that corresponding to FIG. 4 is shown. In the analysis charts, the length of period is shown along the axis of abscissas and the frequency (variation coefficient) is shown along the axis of ordinates. In the analysis of periodicity of yarn size variation, the length of period corresponding to a length of yarn wound from one edge to the other edge of a package is considered. The length of yarn generally is in a range from 0.5 to 10 m, although it varies with a length of traversing width at formation of package traversing width. The signal attributable to yarn size variation at the edge portions is observed as a peak peculiar to the variation coefficient in the periodic length in FIG. 6. In the present invention, the variation coefficient must be 0.4% or less. With a variation coefficient exceeding 0.4%, the yarn size variation attributable to the edge portion come to produce defect in a resultant fabric. The variation coefficient is desirable to be smaller. With a variation coefficient of 0.2% or less, quality of a fabric obtained becomes extremely good.

4) Heat of Crystallization

In the present invention, it is preferable that a preoriented yarn wound on a package of PTT preoriented yarn exhibits an amount of heat generation at crystallization of 10 J/g or less measured by a differential scanning calorimetry (DSC). Amount of heat generated at crystallization measured by a differential scanning calorimetry (DSC) is a value obtained on the preoriented yarn on a package by measuring according to the method explained herein after. The amount of heat generated at crystallization is the amount of heat generated at the time the preoriented yarn crystallizes, and can be an indicator of degree of crystallization. Accordingly, the smaller the amount of heat generation at crystallization the more crystallized is the preoriented yarn.

In case where a PTT preoriented yarn is hardly crystallized, the amount of heat generation exceeds 10 J/g. On the other hand, with crystallization sufficiently promoted, heat of crystallization cannot be measured by this measuring method. One of the advantageous merits claimed by preoriented yarn is that the yarn as such, namely without need of draw false twist processing, can be provided for fabricating process to convert into either woven or knitted fabric of good quality. Another merit worthy to be noted is that promotion of self-crystallization in the preoriented yarn is restrained either in a case where the preoriented yarn is fed to draw false-twist processing or in a case where the preoriented yarn is placed for a long time in a ambient elevated temperature at 40° C. or greater.

In the present invention, with the heat of crystallization being 10 J/g or less, promotion of self-crystallization of preoriented yarn can be restrained. The amount of heat of crystallization is desired to be smaller; preferably 5 J/g or less, more preferably, 2 J/g or less.

5) Crystalline Orientation

In the present invention, it is desirable that the preoriented yarn wound on a PTT preoriented yarn has a crystalline orientation of from 80 to 95%.

Crystalline orientation is an indication for orientation of crystal measured by wide angled X ray diffraction method hereinafter described. Orientation of crystalline cannot be determined unless the preoriented yarn is crystallized, as diffraction attributable to the presence of crystallization is not observed in the wide angled X ray diffraction measurement. As the PTT preoriented yarn according to the present invention has a high crystalline orientation as mentioned above, crystalline orientation of the preoriented yarn can be determined. With a crystalline orientation less than 80%, strength at break of PTT preoriented yarn becomes about 2 cN/dtex or less. When the yarn, as such, without being drawn is provided for producing a fabric either woven or knitted, the resultant fabric is in sufficient in strength and cannot be provided for use according as it is used. The crystalline orientation available of the present preoriented yarn is 95% at the maximum. The higher the crystalline orientation, the greater the tenacity or strength of the preoriented yarn becomes. A preferred value of crystalline orientation ranges from 85 to 95%.

The preoriented yarn accumulated on the preoriented yarn package of the present invention has preferably a birefringence of from 0.03 to 0.07. With a yarn having a birefringence of less than 0.03, the object of the present invention cannot be achieved because the yarn has a crystalline orientation of less than 80%. With a birefringence exceeding 0.07, the object of the present invention is not attained because increase of difference in dry heat shrinking stress value between the yarn accumulated in the middle portion of package and that in the edge portion of the package is inevitable. A preferred birefringence ranges from 0.04 to 0.06.

The yarn size and the filament size of the single filament composing the present preoriented yarn are not limitative. A yarn size of from 20 to 300 dtex and single filament size of from 0.05 to 20 dtex may be used.

For the purpose of imparting smoothness, cohesiveness and resistance to static electricity to the preoriented yarn, it is preferable that finish oil is adhered to the preoriented yarn in an amount ranging from 0.2 to 2 by weight on the yarn. In order to impart unwinding property and improved cohesion of the single filaments required at false-twist processing, the single filaments composing the present yarn may be interlaced so that the yarn has an interlaced single filament node rate of 50 nodes/m or less.

In the following, processes for preparation of the PTT preoriented yarn according to various embodiments of the present invention will be explained in detail in reference to FIG. 7.

Figure 7:
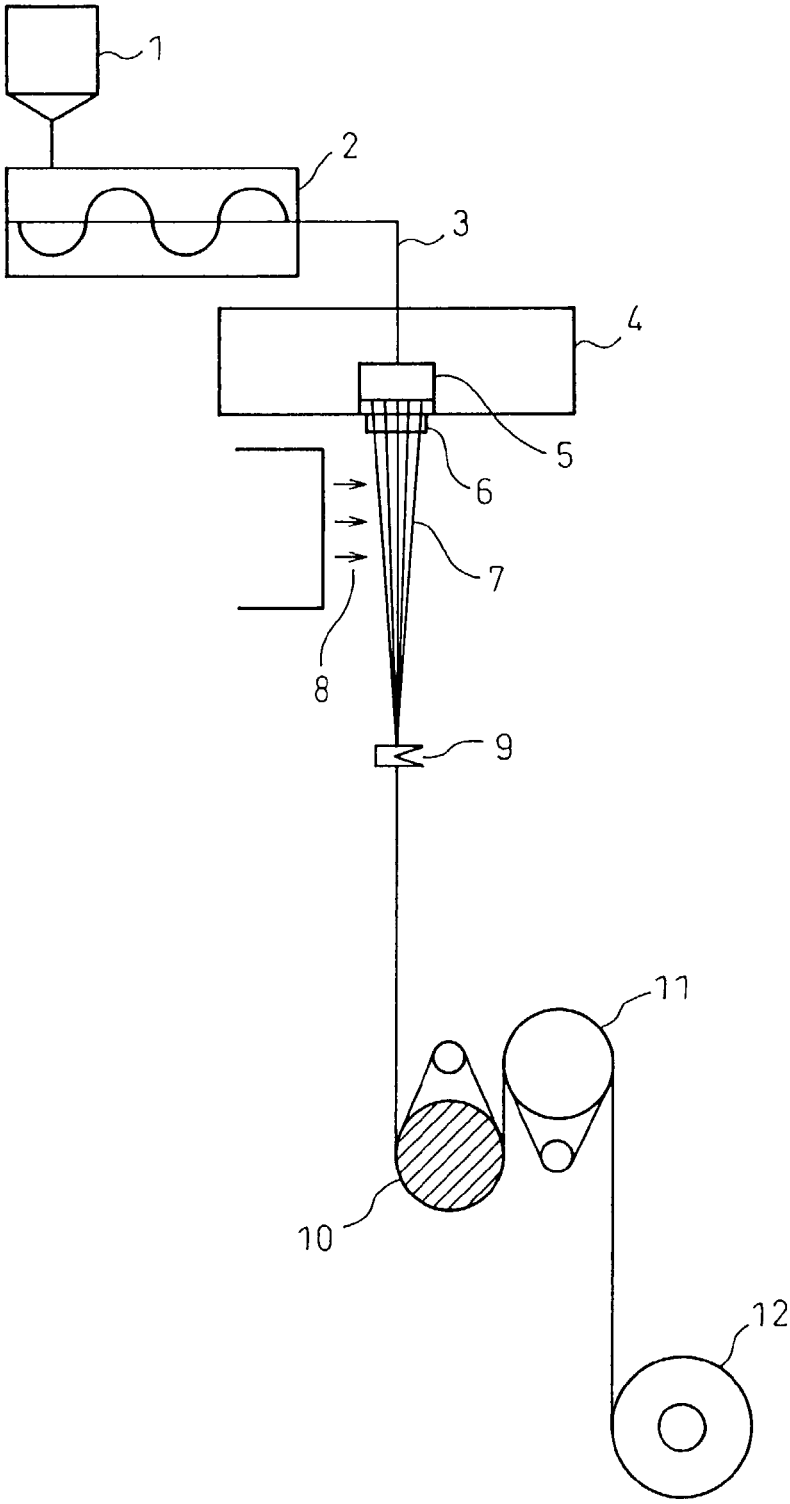
FIG. 7 is a schematic drawing showing a process for producing a preoriented yarn package; the following are the designations of respective numerals in the drawing.

In FIG. 7, PTT pellets having a moisture content (moisture retain) of 30 ppm or less are fed into a extruder 2 heated at a temperature ranging from 255 to 270° C. to melt. The melted PTT is then transferred to a spin-head heated at a temperature ranging from 250 to 270° C. through vent 4 and metered by gear pump. The melt is subsequently extruded into the form of multifilamentary yarn through a spinning nozzle 6 with a plurality of orifices mounted in the spin-pack 5 into a spinning chamber to form a multifilamentary yarn.

The temperature of the extruder and the spin-head is chosen to be between 250 and 270° C. at a best suitable condition in accordance with the intrinsic viscosity and shape of the PTT pellet. The PTT multifilamentary yarn extruded into the spinning chamber is cooled to solidify by cooling airflow 8 at a temperature down to the room temperature. The solidified filamentary yarn is then given an application of spin-finish oil, and then heat-treated by means of withdrawal and heated godet rolls 10 and 11 (hereinafter referred concisely as heated godet roll) rotating at a predetermined rate, and is subsequently wound into the form of a preoriented yarn package 12 in which the yarn is of a predetermined yarn size. The preoriented yarn 12 is given an application of spin-finish oil by means of spin-finish oil applicator 9 before contacting the heated godet roll 10. The spin-finish oil applied to the preoriented yarn used is an aqueous emulsion type spin-finish oil. The aqueous emulsion of spin-finish oilcontains a spin-finish oil at a concentration of 10% by weight or more, preferably 15 to 30% by weight. If needed, the preoriented yarn may be interlaced by means of an interlacing apparatus placed between the spin finish applicator 9 and the withdrawal godet roll 10, and/or between the withdrawal godet roll 11 and a winder.

(a) Spinning Tension

In producing the preoriented yarn according to the invention, it is necessary that the tension imparted to the yarn under spinning must be kept at 0.20 cN/dtex or less. The spinning tension is defined as a value obtained by dividing the tension (cN) measured at a point 10 cm below the spin-finish oil applicator shown in FIG. 7, by the yarn size (d Tex).

When a spinning tension exceeds 0.17 cN/dtex, yarn breakage is encountered due to occurrence of abrasive friction between the spinning yarn and the spin-finish oil applicator and, in consequence, stable production of preoriented yarn becomes difficult to perform.

The smaller the spinning tension, the better spinning can be carried out. At 0.17 cN/dtex, more preferably at 0.15 cN/dtex, a stable spinning operation can be ensured in a commercially operated continuous spinning line.

The spinning tension is adjusted by cohering the multifilamentary yarn under spinning. Specifically, the adjustment of spinning tension is done in reference to spinning speed, the traveling distance from the face of spinneret to a cohering point of the traveling yarn and kind of cohering guide means. "It is preferable that the spinning tension is adjusted in a manner in which the application of a spin-finish oil and cohering of the multifilamentary yarn are concurrently done at a single operation."

(b) Take-up Winding Condition

In a process according to the invention, a package must be kept at 30° C. or less during its formation by winding. When a temperature of a packages exceeds 30° C., the object of the present invention cannot be attained because variation coefficient of periodicity of yarn size variation exceeds 0.4% "even if the yarn size variation value, U % is maintained at any small value during winding." In the practice of the winding, the temperature of the package is preferably kept at 30° C. or less at any time from the start to the completion of winding.

A means for keeping the package at 30° C. or less is preferably a means "capable of intercepting any heat transfer and radiant heat reaching the revolving bobbin shaft from motor,", which is the body of the rotating drive means of winding machine and the heat source. The object can be successfully achieved by cooling the package under winding or the circumstantial space in the vicinity of the package under winding by blowing an airflow cooled to 30° C. or less.

The lower the temperature of the package under winding, the better the package obtained. A preferred temperature is around 25° C. or lower. With a temperature exceedingly low, a greater amount of energy is needed to keep the low temperature. For this reason, a further preferred range of temperature is around from 20 to 25° C.

(c) Take-up Winding Speed

In the production of preoriented yarn package, a winding speed must be in a range from 1,900 m/min to 3,500 m/min. With a winding speed of less than 1,900 m/min., orientation of preoriented yarn is small, and it is difficult to maintain the yarn size variation value, U % and yarn size variation coefficient within the scope of the present invention.

Further, in case where a heat treatment of yarn is carried out at a winding speed of less than 1900 m/min., tension under a heat-treatment at a temperature of 70° C. becomes 0.02 cN/dtex or less and, in consequence, yarn size variation become of yarn becomes increased and yarn breakage aw well as formation of fluffs become liable.

With a winding speed exceeding winding speed of 3500 m/min., the winding tension exceeds 0.20 cN/dtex, the object of the invention cannot be achieved as the difference in dry thermal shrinking stress value between the end edge portions and the middle portion of the package exceeds 0.01 cN/dtex. A preferred take-up winding speed is in a range from 2,500 m/min to 3,200 m/min, more preferably from 2,700 to 3,200 m/min.

(d) Heat Treatment Condition

In the process for producing a preoriented yarn package, it is preferable that a temperature of heat treatment under winding of preoriented yarn is in a range from 70 to 120° C., and that a tension thereat is in a range from 0.02 to 0.1 cN/dtex. The heat treatment is performed by heating the preoriented yarn while the yarn is wound 2 to 10 times over the peripheral surface of the heated godet rolls. Accordingly, the temperature of heat treatment for preoriented yarn is substantially the same with that of godet rolls. "With the temperature of the heat treatment brought at 70 or higher," heat of crystallization of preoriented yarn becomes 10 J/g or less, whereby the object of the invention is achieved. Heat treatment at a temperature exceeding 120° C. is not suitable. With a heat treatment at a temperature exceeding 120 degree, the preoriented yarn sways its thread line on the surface the godet rolls due to sudden exposure of a low crystallized yarn to an elevated temperature, and becomes readily fluffed and broken. Yarn size variation value, U % of the resultant yarn exceeds 1.5% and accordingly not suitable. A preferred temperature for heat treatment ranges from 80 to 110° C., more preferably 90 to 110° C.

Figure 8:
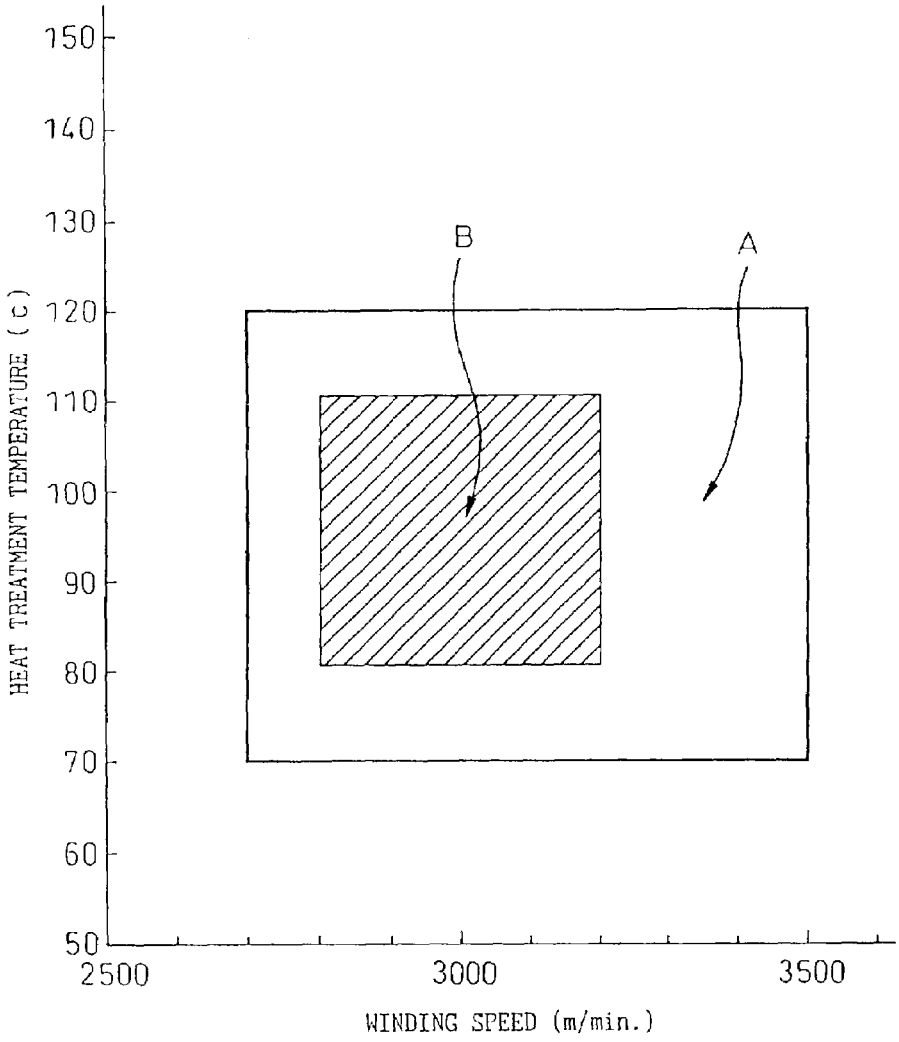
FIG. 8 shows the relation between the heat-treating temperature and winding speed in the preparation of a preoriented yarn package according to the invention.

FIG. 8 shows the ranges of winding speed and temperature of heat treatment used in the present process for producing a preoriented yarn and their preferred ranges. In FIG. 8, area A is a preferred range and area B is more preferred range.

In addition to the temperature of heat treatment mentioned above, it is preferable to control the tension acting on the traveling yarn in a range from 0.02 to 0.10 cN/dtex at the heat treatment in the process for producing a preoriented yarn according to the present invention. The tension during the heat treatment is the tension acting on the preoriented yarn that is measured at a position either on the heated godet roll or just after the yarn leaves the godet roll. The tension is adjusted by controlling the temperature of the heated godet rolls and the ratio of speed of godet roll to either the withdrawal roll or deflecting roll before or after the heated godet roll.

With a tension less than 0.02 cN/dtex at the heat treatment, fluctuation of the thread line of the traveling yarn over the godet roll enhances remarkably, and the traveling of the preoriented yarn becomes unstable. With a tension exceeding 0.10 cN/dtex, problematic tightened winding of package tends to be produced. A preferred tension at the heat treatment is in a range from 0.03 to 0.07 cN/dtex. Number of the heated godet rolls is not specifically limited; use of either a pair or two pairs of godet rolls is ordinarily done. In case where two pairs of godet rolls are used, it is preferable that one of the pairs is heated or both are heated. Period for the heat treatment is not specifically limited; ordinarily the heat treatment is applied for 0.01 to 0.1 second.

(2) Temperature at Storing

In a draw false twist texturing of the preoriented yarn according to the present invention, using a preoriented yarn package prepared by winding the yarn without applying the heat treatment at winding, it is preferable that the preoriented yarn package is fully kept at a temperature of 30° C. or less during the entire course of handling steps including the take-up winding, storing and false-twisting processing step.

From storing till false twisting, if a temperature of the package exceeds 30° C., the package tends to increase in its protrusion height of the edge portions leading to deterioration in the quality of a resultant false twisted textured yarn. During storing the package is preferably kept at 25° C. As means for maintaining the temperature at 30° C., the package is preferable stored in a warehouse or room equipped with an apparatus for regulating the temperature.

With use of the preoriented yarn package according to the present invention, a fabric, whether knitted or woven, having a good quality and free from periodical occurrence of uneven dyeing defect, can be obtained and the fabric exhibits a soft feel.

The preoriented yarn package according to the present invention as such, namely without being drawn, may be used for producing knitted or woven fabric, and also the yarn can be processed by means of twisting, false twisting or fluid jet processing (Taslan texturing process) before it is made into the form of fabric. The fabric may be made entirely by using the preoriented yarn package according to the present invention; otherwise the fabric may be a composite fabric in which another fiber is partly used in a mixture. The other fiber which may be a part of the composite fabric is either staple fiber or filamentary yarn composed of a polyester fiber, cellulose fiber, nylon 6 fiber, nylon 66 fiber, acetate fiber, acrylic fiber, elastomeric polyurethane fiber, wool, silk and the like, but not limitative.

When a composite knitted or woven fabric is formed of an intermingled yarn consisting of the other fiber and the preoriented yarn of the preoriented yarn package according to the present invention, various intermingling methods may be applied; the two filamentary yarns are intermingled and then subjected to a draw false twist processing, either one of the two yarns is draw false twist processed prior to intermingling, the two yarns are separately false twisted prior to interlace mingling, interlace mingling the two yarns prior to Taslan texturing, Taslan intermingling, and the like. The intermingled yarn obtained by one of these methods has preferably number of interlaced nodes of 10 nodes/m or more.

A false twist texturing method which can be used in the present preoriented yarn package includes pin-type method, friction type method, nipping-belt type method, air false twisting method and the like method. Type of heating system for a false twisting system can be either single heater type or double-heater type, although single heater type system is preferred in order to obtain a highly stretchable yarn.

The false twist texturing process may be either of draw false twist texturing or of non-draw false twist texturing. The temperature of false twisting heater is controlled so that a temperature of traveling yarn just after the exit of the first heater may be in a range from 130 to 200° C., preferably from 150 to 180° C., especially preferred is in a range from 160 to 180° C. An elastic elongation ratio of a false twist texturinzed yarn which is prepared by a single heater type false twist texturing is in a range from 100% to 300%; a preferred value of elastic elongation of texturinzed yarn is 80% or greater.

In case of need, a false twist textured yarn may be prepared by making the once false twisted yarn subsequently heat treated using a second heater. A temperature of the second heater is selected in a range from 100 to 210° C., preferably temperature within −30° C. to +50° C. relative to the temperature of the traveling yarn at just after the exit of the first heater. The over feeding ratio of the traveling yarn in the second heater (second over feeding ratio) is preferably in a range +3% to +30%.

BEST EMBODIMENT OF THE INVENTION

In the following, the present invention will be explained in more detail by way of examples. The present invention, however, is not limited by the examples. The methods and conditions for measurements of properties in the examples are explained in the following.

(1) Intrinsic Viscosity

Intrinsic viscosity (η) is determined by the value obtained on the basis of the definition the following formula:

$$[\eta]=Lim(\eta r-1)/C \quad C\rightarrow 0$$

In the formula of definition, eta$_r$ is defined as relative viscosity and measured value obtained by dividing a viscosity at 35° C. of a solution of a PTT polymer dissolved in o-chlorophenol having a purity of 98%. C is a concentration of the polymer solution in terms of g/100 ml.

(2) Elongation at Break

Elongation at break of yarn is measured according to JIS-L-1013.

(3) Heat of Crystallization

Heat of crystallization of a yarn is measured using a differential scanning calorimetry (DSC); specifically DSC-5 available from Shimazu Seisakusho Co., Ltd. 5 mg of a sample of a preoriented yarn is precisely weighed, and the temperature of the weighed sample is raised at 5° C./min from 25 to 100° C. to measure the heat generation by the differential scanning calorimeter.

The amount of heat of crystallization was computed an area of peak of heat generated between 40 and 80° C. on the chart using the computation program equipped on the differential scanning calorimeter.

(4) Crystalline Orientation

Using an X-ray diffraction device, a diffraction intensity curve is drawn from 7 to 35 degree at a diffraction angle 2 θ on a sample having a thickness of 0.5 mm. The measurement is carried out under the following conditions:

30 KV; 80 A; scanning rate, 1 degree/minute; chart speed, 10 mm/minute; time constant, 1 second; receiving slit, 0.30 mm.

The respective reflections drawn at 2 θ=16° and 2 θ=22° are represent the face (010) and the face (110). Further, another diffraction intensity curve for the face (010) is drawn in the direction between −180 degree to +180 degree. A mean value of the diffraction intensity curves obtained at −180 degree and +180 degree is found and the mean value is the base line. Perpendicular lines are drawn from the tops of the peaks towards the base line to find the mid point of the heights of the peak. A horizontal line is drawn through the mid points, and a distance between the two intersecting points of the diffraction intensity curve with horizontal line through the mid points is measured. The obtained distance value is converted to an orientation angle (H). The crystalline orientation is given by the following formula.

$$\text{Crystalline orientation } (\%)=(180-H)\times 100/180$$

(5) Dry Thermal Shrinking Stress Value

As an apparatus for measuring thermal shrinking stress value, a KE-2 (trade name) available from Kanebo Engineering Company is used. A length of 20 cm of a drawn yarn is cut off from a sample yarn, and cut-off sample yarn is tied at its ends to form a loop, and subsequently set on the measuring apparatus. A chart of temperature variation of thermal shrinking stress value is drawn on a sampled yarn under an initial load of 0.044 cN/dtex while the temperature of the sample yarn is raised at a rate of 100° C./min.

The chart of thermal shrinking stress is a crest shaped curve having a peak between about 60 and about 90° C. The value at peak is defined as the dry thermal shrinking stress. This measuring operation is carried out both on a yarn accumulated at the edge portions of a package and at the middle portion of the package, five values obtained for each sample from which a mean value for a sample are computed. A difference of the mean values is determined as the difference in the dry thermal shrinking stress values.

(6) Birefringence

According to the instructions described on page 969 of The Fiber Handbook, Fiber material, 2nd impression (1978), birefringence was determined based on the retardation of polarized light beam observed on the surface of a fiber using an optical microscope and a compensator.

(7) Yarn Size Variation

U % was determined at the same time when a yarn size variation value chart (Diagram Mass) was drawn according to the following method.

| | |
|---|---|
| Measuring device: | Evenness tester (Uster tester UT-3, available from Zellwerger Company of Uster) |
| Measuring conditions: | |
| Yarn traveling speed | 100 m/min. |
| Intensity of disk tension | 2.5% |
| Tension | 1.0 |
| Entry pressure | 2.5 hp |
| Twist | z 1.5 |
| Measuring length of yarn | 250 m |
| Scale | Preset in accordance with yarn size variation. |

Yarn Size Variation Value U %:

Variation chart and an indicated value were read directly to obtain the value.

Yarn Size Variation Coefficient:

A height of crest-like protruding signal, namely, yarn size variation coefficient was determined based on a periodicity analysis chart, namely, Spectrum Mass (periodicity diagram of dispersion CV of yarn size variation) which was obtained by utilizing a yarn size variation periodicity analysis software attached to the yarn size variation measuring apparatus.

(8) Elastic elongation and elastic modulus of elasticity of false twist textured yarn Elastic elongation and elastic modulus of elasticity of a false twist textured yarn were measured according to Method (A) described in JIS-L-1090.

(9) Difference in Diameters Within a Package

Figure 2:
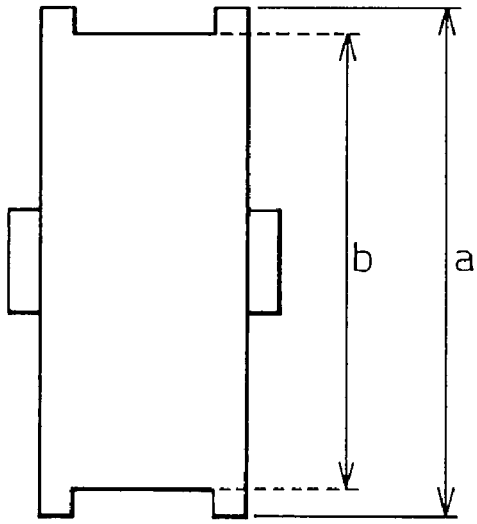
FIG. 2 is a schematic illustration showing a package with protruded edge portions.

A diameter at the edge portion (a) of a package and that of the middle portion (b) at the package are measured respectively as in the manner shown in FIG. 2, and the difference is computed by the following formula:

$$\text{Difference in the diameters } (mm)=a-b$$

(10) Tension in a Yarn at the Heat Treatment

Measurement of the tension in a yarn at the heat treatment was carried out using Rothschild Min Tens R-046. Tension T 1 (cN) exerted on the fiber traveling at a position where the fiber under the heat treatment leaves the heated godet roll (in the case of the process line shown in FIG. 6, the position between heated godet roll 10 and deflecting roll).

Tension in a yarn at the heat treatment is found by dividing the measured tension value by yarn size D (dtex) of the yarn (see the following formula):

$$\text{Tension at the heat treatment}=T\,1/D$$

(11) Temperature of Package

Temperature of the package at take-up winding is measured using a non-contacting type thermometer as follows: Thermoviewer JTG-6200 available from Nippon Electronic (JEOL) Company Ltd.

(12) Stability of Spinning

In each example, melt spinning-subsequently following drawing is carried out for a period of 2 days using melt spinning with spinning nozzles for 8 ends of yarn per spindle which is continuously connected with draw-twister.

Stability of each spinning was evaluated by estimation of number of occurrences of yarn breakage during this period, and the frequency of fluff existing drawn yarn package (ratio of number of fluff existing in drawn yarn packages to the total drawn yarn packages produced) during 2 days of spinning and drawing consecutive operation. The following is the criteria for the evaluation:

◎ No yarn breakage occurred. A ratio of number of fluff existing drawn yarn package is 5% or less.

○ Yarn breakage occurred less than 2 times. A ratio of fluff existing drawn yarn package is less than 10%.

X Yarn breakage occurred 3 times or more. A ratio of fluff existing drawn yarn package is more than 10%.

(13) Evaluation of Qualities of Preoriented Yarn and Textured Yarn (i) Preparation of Textured Yarn by False Twist Texturing Process Preoriented yarn was textured by false twist process using the following conditions.

| | |
|---|---|
| False twist texturing machine: | 33 H false twist texturing machine available from Murata Machinery Works Co. Limited. |
| False twist conditions | |
| Yarn processing speed | 300 m/min. |
| Number of false twist inserted | 3230 times/m |
| Draw ratio | Preset so that the elongation of texturinzed yarn |
| Feed ratio | −1% |
| First heater temperature | 170 degree Celsius |

(ii) Evaluation of Uniformity Dyeing (Dyeing Grades)

Tubular knitted fabric is prepared by knitting preoriented yarn or false twist textured yarn by means of single fed type knitting machine and dyed under the following dyeing conditions. Three skilled panelists evaluated the dyed fabric by grading the dyed fabric on a scale of 10 grades with reference to an in-house standard dye specimen. The higher the grade, the better the evenness of dyeing.

| Dyeing conditions: | |
|---|---|
| Dye | Foron Navy S-2GL Glan 200% (O.G Company Ltd.) |
| Dye concentration | 1.5% |
| Dispersing agent | Disper TL (Meisei Chemical Industry Company Ltd.) |
| Concentration of Dispersing agent | 2 g/L |
| Bath ratio | 1:18 |
| Dyeing temperature | 97° C. |
| Dyeing period | 30 minutes |

Evaluation Criteria:

Grade 10 Neither shade barré of dyeing nor unevenness of dyeing is noticed.

Grade 8–9 Shade barré of dyeing and unevenness of dyeing are slightly noticed.

Grade 6–7 Shade barré of dyeing and unevenness of dyeing are observed.

Grade 4–5 Shade barré of dyeing and unevenness of dyeing is noticeable.

Grade 1–3 The presence of undrawn portion of yarn is noticed.

(Grades above grade 6 are eligible.)

Evaluation of Quality:

◎ Excellent (Grades 8–10)

○ Good (Grades 6–7)

X Unacceptable owing to the presence of Shade barré of dyeing (Grades 5 or lower)

EXAMPLES 1–5

Examples 1 through 5 show examples in which the heat treatment conditions of a preoriented yarn package affect the shape of a preoriented yarn package and physical properties of the preoriented yarn.

Using a spinning apparatus and winder shown in FIG. 1, a PTT in the form of pellets containing 0.4% by weight of titanium oxide having a intrinsic viscosity of 0.91 dl/g were spun at the following conditions to prepare a preoriented PTT filamentary yarn package, in which the yarn has a yarn size of 101 dtex/36 filaments. In winding the preoriented yarns, two pairs of godet rolls are used and the godet roll of the first stage godet roll (see numeral 10, FIG. 7) was heated at the respective temperatures as shown in Table 1. The tension given to the traveling yarn was controlled by adjusting the peripheral speed of the unheated godet roll of the second stage (see numeral 11 in FIG. 7).

| Spinning conditions: | |
|---|---|
| Temperature for drying the pellet and the moisture content of the dried pellet: | 110° C., 25 ppm |
| Temperature of extruder: | 260° C. |
| Temperature of spinning head: | 265 degree Celsius |
| Diameter of orifices in the spinning nozzle: | 0.45 mm |

Extrusion Amount of Polymer:

To be set for the respective spinning speed so as to make a preoriented yarn have a yarn size of 101 dtex.

Cooling Air Flow:

Temperature, 22 degree Celsius; Relative Humidity, 90%; rate of air flow, 0.5 m/sec.

Spin Finish Oil:

Aqueous emulsion containing 10% by weight of polyether ester based finish oil

Distance from the spinning nozzle to the spin finish oil applicator nozzle: 75 cm Tension applied to spinning yarn: 0.11 cN/dtex Winding conditions:

Winder Teijin Seiki Co., Ltd. Type AW-909, self-driving type axes for bobbin and contacting roll Winding speed 3000 m/min.

Temperature of package at winding 25 degree Celsius

| Preoriented yarn package: | |
|---|---|
| Yarn size | 101.1 dtex |
| Water regain | 0.6% by weight |
| Birefringence | 0.058 |
| Diameter of package | 31 cm |
| Winding width | 10 cm |
| Length of yarn wound between the edges of package | 90 cm |
| Amount of winding | 5.2 kg/bobbin |

As seen from Table 1, Examples 1 through 5 attain a good spinning ability. The false twist textured yarn and the tubular knitted fabric thereof, which are prepared from the preoriented yarn packages according to the examples, exhibit good quality of dyeing. The woven fabrics prepared using the preoriented yarn packages as filling yarns exhibit a good quality of dyed fabrics.

Preoriented yarn package in the form of wound up shape similar to Examples 6 to 11 were obtained under the heat treatment temperature and winding speed as shown in Table 2. In the examples and comparative examples, the temperature of the packages was kept at 25° C. The respective PTT preoriented yarn packages obtained were provided for false twist process to produce false twist textured yarns after they had been stored for 30 days at a temperature of 35° C. Properties of the resultant false twist textured yarn are shown in the following. Qualities of dyed textured yarns are shown in Table 2.

| Properties of false twist textured yarn: | |
|---|---|
| Yarn size | 84.5 dtex |
| Tenacity at break | 3.3 cN/dtex |
| Elongation at break | 42% |

TABLE 1

| | Heat treatment temperature (° C.) | Tension in yarn at heat treatment (cN/dtex) | Spinning stability | Heat of crystallization (J/g) | Crystalline orientation (%) | Difference in dry thermal shrinking stress value (cN/dtex) | Difference in diameter within a yarn package (mm) | Yarn size variation value (U %) (%) | Scatter value CV for Periodicity of yarn size variance (%) | Elongation (%) | Quality of dyeing |
|---|---|---|---|---|---|---|---|---|---|---|---|
| Example 1 | 80 | 0.05 | ◎ | 5 | 88 | 0.007 | 4 | 0.7 | 0.3 | 91 | ○ |
| Example 2 | 90 | 0.04 | ◎ | 2 | 89 | 0.004 | 3 | 0.6 | 0.3 | 91 | ◎ |
| Example 3 | 100 | 0.03 | ◎ | 0 | 89 | 0.003 | 3 | 0.7 | 0.2 | 89 | ◎ |
| Example 4 | 100 | 0.09 | ◎ | 0 | 90 | 0.006 | 4 | 0.7 | 0.2 | 82 | ◎ |
| Example 5 | 120 | 0.02 | ◎ | 0 | 90 | 0.002 | 4 | 0.9 | 0.3 | 88 | ○ |

EXAMPLES 6–11, COMPARATIVE EXAMPLES 1–2

Examples 6 through 11 are examples showing the effect of heat treatment conditions and winding speed condition applied in producing a preoriented yarn on the winding conditions.

Using the same spinning conditions as those in Examples 1 to 5, PTT preoriented yarn are produced. The tension applied to the respective yarns under the heat treatment was 0.03 cN/dtex.

-continued

| Properties of false twist textured yarn: | |
|---|---|
| Stretch elongation | 192% |
| Elongation elasticity | 88% |

As seen from Table 2, the false twist textured yarns obtained from the PTT preoriented yarn package do not produce unevenness of dyeing but exhibit a good quality as well as excellent crimp performance.

TABLE 2

| | Winding speed (m/min) | Spinning tension (cN/dtex) | Heat treatment temperature (° C.) | Heat of crystallization (J/g) | Crystalline orientation (%) | Difference in dry thermal shrinking stress value (cN/dtex) | Difference in diameter within a yarn package (mm) | Yarn size variation value U % (%) | Scatter CV value for periodicity of yarn size variance (%) | Elongation (%) | Quality of dyeing |
|---|---|---|---|---|---|---|---|---|---|---|---|
| Comparative Example 1 | 1800 | 0.08 | 50 | 13 | Not obtainable | 0.012 | 12 | 1.6 | 0.8 | 180 | x |
| Example 6 | 2500 | 0.10 | 70 | 10 | 82 | 0.009 | 5 | 1.2 | 0.4 | 120 | ○ |
| Example 7 | 2800 | 0.14 | 80 | 8 | 87 | 0.007 | 4 | 1.0 | 0.4 | 105 | ◎ |
| Example 8 | 3200 | 0.17 | 80 | 4 | 89 | 0.004 | 3 | 1.0 | 0.3 | 81 | ◎ |
| Example 9 | 3200 | 0.17 | 100 | 0 | 91 | 0.002 | 3 | 1.1 | 0.3 | 79 | ◎ |
| Example 10 | 3200 | 0.17 | 120 | 0 | 92 | 0.002 | 3 | 1.2 | 0.3 | 76 | ○ |
| Example 11 | 3500 | 0.19 | 80 | 4 | 89 | 0.008 | 5 | 1.2 | 0.4 | 62 | ○ |
| Comparative Example 12 | 3700 | 0.24 | 80 | 3 | 90 | 0.021 | 8 | 1.6 | 0.5 | 57 | x |

EXAMPLES 12–14, COMPARATIVE EXAMPLES 3

Examples 12 through 14 are examples showing the effect of temperature of a package under winding. Varying the cooling condition of a preoriented yarn package, a package was formed by winding while the temperature of the package was kept at a temperature shown in Table 3. The resultant shapes of packages as well as properties of the preoriented yarn wound on the packages are tabulated in Table 3.

As seen in Table 3, the packages formed by winding at a temperature within the range of the present invention have good wound shape. The tubular knitted fabrics obtained from the preoriented yarn wound on the preoriented yarn packages had good quality. Further, woven fabrics in which the yarn unreeled from the preoriented yarn packages is woven as the filling yarns exhibited good quality even after the fabrics had been dyed.

TABLE 3

| | Temperature of package (° C.) | Moisture content (wt. %) | Difference in dry thermal shrinking stress value (cN/dtex) | Difference in diameter of package (mm) | Yarn size variation value U % (%) | Scatter CV value of periodicity of yarn size variation (%) | Quality of dyeing |
|---|---|---|---|---|---|---|---|
| Example 12 | 20 | 0.8 | 0.001 | 2 | 0.8 | 0.2 | ◎ |
| Example 13 | 25 | 0.8 | 0.002 | 3 | 0.8 | 0.2 | ◎ |
| Example 14 | 30 | 0.7 | 0.007 | 4 | 0.9 | 0.3 | ○ |
| Comparative Example 3 | 43 | 0.7 | 0.013 | 8 | 1.0 | 1.0 | x |

EXAMPLES 15–17, COMPARATIVE EXAMPLE 4

Examples 15 through 17 are examples showing the effect of tension in the yarn under spinning. Except that the distances from the spinning nozzle to the spin finish applicator nozzle are varied at spinning as shown in Table 4, the preoriented yarn packages were formed using the same spinning conditions as those in Example 2. The resultant spinning abilities are shown in Table 4. As seen in Table 4, a good spinning ability was attained when a spinning tension was within a range of the present invention.

TABLE 4

| | Location of SFOA nozzle (cm) | Spinning tension (cN/dtex) | Spinnability | Difference in dry thermal shrinking stress value (cN/dtex) | Difference in diameter of package (mm) | Yarn size variation value U % (%) | Scatter value of periodicity of yarn size variation (%) | Quality of dyeing |
|---|---|---|---|---|---|---|---|---|
| Example 15 | 60 | 0.09 | ◎ | 0.004 | 3 | 0.8 | 0.3 | ◎ |
| Example 16 | 90 | 0.13 | ◎ | 0.003 | 3 | 0.7 | 0.3 | ◎ |
| Example 17 | 120 | 0.16 | ○ | 0.004 | 3 | 0.9 | 0.3 | ◎ |
| Comparative Example 4 | 150 | 0.21 | x | 0.005 | 4 | 1.0 | 0.4 | ○ |

SFDA = Spin finish oil applicator

EXAMPLES 18–22, COMPARATIVE EXAMPLES 5

Examples 18 to 22 are examples showing the effect of winding speed on processability of false twist texturing process in the case where the heat treatment of preoriented yarn is eliminated.

Using a spinning apparatus and winder shown in FIG. 7, PTT in the form of pellets containing 0.4% by weight of titanium oxide having a intrinsic viscosity of 0.91 dl/g were spun at the following spinning conditions under various withdrawal speeds to produce packages of PTT preoriented yarn having a yarn size of 101 dtex/36 filaments.

| Spinning conditions: | |
|---|---|
| Temperature for drying the pellet and the moisture content of the dried pellet: | 110° C., 25 ppm |

-continued

| Spinning conditions: | |
|---|---|
| | 110° C., 25 ppm |
| Temperature of extruder: | 260° C. |
| Temperature of spinning head: | 265° C. |
| Diameter of orifices in the spinning nozzle: | 0.45 mm |
| Extrusion amount of polymer: | To be set for the respective spinning speed so |

-continued

| Spinning conditions: | |
|---|---|
| | as to make a preoriented yarn have a yarn size of 101 dtex. |
| Cooling air flow: | Temperature, 22 degree Celsius; Relative Humidity, 90%; rate of air flow, 0.5 m/sec. |
| Spin finish oil: | Aqueous emulsion containing 10% by weight of polyether ester based finish oil |

Distance from the spinning nozzle to the spin finish oil applicator nozzle: 75 cm Tension applied to spinning yarn: 0.11 cN/dtex

| Winding conditions: | |
|---|---|
| Winder | Teijin Seiki Co. Ltd. Type AW-909, self-driving type axes for bobbin and contacting roll |
| Winding speed | 3000 m/min. |

-continued

| | |
|---|---|
| Temperature of package at winding (Non-contacting type thermometer) | 20 degree Celsius |
| Preoriented yarn package: | |
| Yarn size | 101.1 dtex |
| Water regain | 0.6% by weight |
| Diameter of package | 31 cm |
| Winding width | 19.3 cm |
| Length of yarn wound between the edges of package | 90 cm |
| Amount of winding | 5.2 kg/bobbin |

The preoriented yarn obtained was draw false twist texturinzed after the preoriented package had been left stored in an environment maintained at a temperature of 20° C. and at a relative humidity of 90% for 5 days.

In Table 5, the shape of the preoriented yarn package at false twist texturing, yarn size variation values measured while the preoriented yarn is unwound from the package, processability of false twist texturing of the yarn and a result of evaluation on the quality of dyed texturinzed yarn are shown.

As seen in Table 5, the preoriented yarn package according to the present invention exhibits good false twist texturing process ability and dyed texturinzed yarn had a good dyeing quality.

The following are the properties of a draw false twist textured yarn obtained by using the preoriented yarn package according to Example 19. The false twist texturized yarn had a good crimp property.

| Properties of false twist texturized yarn: | |
|---|---|
| Yarn size | 87.6 dtex |
| Tenacity at break | 2.9 cN/dtex |
| Elongation at break | 47% |
| Stretch elongation | 143% |
| elongation elasticity | 92% |

TABLE 5

| | Winding speed (m/min) | Spinning tension (cN/dtex) | Spinnability | Difference in diameter of package (mm) | Yarn size variation value U % (%) | Yarn size variation co-efficient (%) | Draw false twist processability | Quality of dyed texturized yarn | Comprehensive rating |
|---|---|---|---|---|---|---|---|---|---|
| Example 18 | 2000 | 0.09 | ◎ | 1 | 0.8 | 0.2 | ◎ | ○ | ○ |
| Example 19 | 2500 | 0.10 | ◎ | 2 | 0.8 | 0.3 | ◎ | ◎ | ◎ |
| Example 20 | 2750 | 0.13 | ◎ | 2 | 0.9 | 0.3 | ◎ | ◎ | ◎ |
| Example 21 | 3000 | 0.14 | ◎ | 4 | 1.0 | 0.4 | ○ | ○ | ○ |
| Example 22 | 3500 | 0.19 | ○ | 5 | 1.0 | 0.4 | ○ | ○ | ○ |
| Comparative Example 5 | 3750 | 0.25 | x | 6 | 1.3 | 0.8 | x | x | x |

EXAMPLES 23–25, COMPARATIVE EXAMPLE 6

Examples 23 through 25 are examples showing the effect of a temperature of a package, at the winding of a preoriented yarn, on the false twist texturing processability.

The shape of the preoriented yarn package at false twist texturing, yarn size variation values measured while the preoriented yarn is unwound from the package, processability of false twist texturing of the yarn and a result of evaluation on the quality of dyed texturinzed yarn are shown in Table 6.

As seen in Table 6, a good false twist texturing process ability as well as good quality of false twist textured yarn was ensured when a temperature as specified by the present invention was employed. In contrast, the package wound at a temperature described in Comparative Example 7 had a wound shape with exceedingly protruded edges as shown in FIG. 2, and was poor in draw false twist texturing ability and quality of dyed texturinzed yarn.

TABLE 6

| | Temperature of package under winding (° C.) | Difference in diameter of package (mm) | Yarn size variation value U % (%) | Yarn size variation coefficient (%) | Draw false twist processability | Quality of dye Texturized yarn | Comprehensive rating |
|---|---|---|---|---|---|---|---|
| Example 23 | 10 | 0 | 0.8 | 0.1 | ◎ | ◎ | ◎ |
| Example 24 | 20 | 2 | 0.9 | 0.2 | ◎ | ◎ | ◎ |
| Example 25 | 25 | 4 | 0.9 | 0.4 | ○ | ○ | ○ |
| Comparative Example 6 | 35 | 7 | 1.6 | 0.9 | x | x | x |

EXAMPLE 26–34, COMPARATIVE EXAMPLES 7–9

Examples 26 to 34 are examples showing the effect of temperature, on a preoriented yarn package maintained under storing, and the duration of time of storing of the preoriented yarn package, before false twist texturing. A preoriented yarn package was prepared under the same spinning and winding conditions as those in Example 19. The preoriented yarn package obtained was left stored at a storing condition as shown in Table 7 before it is subjected to false twist texturing.

The shape of the preoriented yarn package at false twist texturing, yarn size variation values measured while the preoriented yarn is unwound from the package, processability of false twist texturing and a result of evaluation on the quality of dyed texturinzed yarn are shown in Table 7.

As seen in Table 7, a good false twist texturing processability as well as good quality of false twist texturized yarn was obtained in case where draw false twist texturing is carried out after the preoriented yarn package had been stored while the temperature of the package was maintained within a range of temperature according to the present invention.

INDUSTRIAL APPLICABILITY OF THE INVENTION

The present invention provides an improved PTT preoriented yarn package suitable for use in making clothing, and a process for producing such a package. A preoriented yarn package according to the invention, as such, can be used for supplying a weaving, a knitting and a texturing process with the preoriented yarn, thereby providing fabric goods of PTT fiber, for clothing use, which is soft and free from occurrences of dyeing defects and periodic uneven dyeing.

The invention claimed is:

1. A polytrimethylene terephthalate preoriented yarn package, comprising preoriented yarn formed of poly (trimethylene terephthalate) having an intrinsic viscosity of from 0.7 to 1.3 dl/g and having at least 95 mole % of trimethylene terephthalate repeating unit and 5 mole % or less of another ester-repeating unit, and that is accumulated to form a layer of wound yarn weighing 2 kg or more and satisfying the following conditions (1) to (4):

(1) a difference in diameter between edge portions of the package and a middle portion being in a range from 0 to 5 mm;

TABLE 7

| | Temperature of package (° C.) | Maintaining duration period before false twist processing (in week) | Difference in diameter of package (mm) | Yarn size variation value U % (%) | Yarn size variation coefficient (%) | Draw false twist processability | Quality of dyed texturized yarn | Comprehensive rating |
|---|---|---|---|---|---|---|---|---|
| Example 26 | 10 | 1 | 0 | 0.7 | 0.2 | ◎ | ◎ | ◎ |
| Example 27 | | 2 | 0 | 0.7 | 0.2 | ◎ | ◎ | ◎ |
| Example 28 | | 4 | 0 | 0.7 | 0.2 | ◎ | ◎ | ◎ |
| Example 29 | 20 | 1 | 2 | 0.7 | 0.2 | ◎ | ◎ | ◎ |
| Example 30 | | 2 | 2 | 0.7 | 0.3 | ◎ | ◎ | ◎ |
| Example 31 | | 4 | 3 | 0.8 | 0.3 | ◎ | ◎ | ◎ |
| Example 32 | 25 | 1 | 3 | 0.8 | 0.3 | ◎ | ◎ | ◎ |
| Example 33 | | 2 | 3 | 0.9 | 0.3 | ◎ | ◎ | ◎ |
| Example 34 | | 4 | 4 | 1.0 | 0.4 | ○ | ○ | ○ |
| Comparative Example 7 | 35 | 1 | −16 | 3.8 | 1.0 or more | x | x | x |
| Comparative Example 8 | | 2 | −20 | 4.3 | 1.0 or more | Impossible to be false-twisted | — | x |
| Comparative Example 9 | | 4 | −22 | 4.9 | 1.0 or more | Impossible to be false-twisted | — | x |

(2) a difference in thermal shrinkage of the yarn accumulated at the edge portions and that of the yarn accumulated at the middle portion of the package is 0.01 cN/dtex or less;

(3) a U % value, a variation in yarn size measured while the preoriented yarn is unreeled from the package is 1.5% or less, and a variation coefficient of period of yarn size variation is 0.4% or less; and (4) the preoriented yarn has a heat of crystallization of 10 J/g or less as measured by a differential scanning calorimetry and a crystalline orientation degree of from 80 to 95%.

2. The poly (trimethylene terephthalate) preoriented yarn package according to claim 1, wherein the preoriented yarn has a birefringence of from 0.03 to 0.07.

* * * * *